US009146494B2

(12) United States Patent
Matsushita

(10) Patent No.: US 9,146,494 B2
(45) Date of Patent: Sep. 29, 2015

(54) IMAGE FORMING APPARATUS

(71) Applicant: Yuichi Matsushita, Nagoya (JP)

(72) Inventor: Yuichi Matsushita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 16 days.

(21) Appl. No.: 14/039,815

(22) Filed: Sep. 27, 2013

(65) Prior Publication Data

US 2014/0093264 A1 Apr. 3, 2014

(30) Foreign Application Priority Data

Sep. 28, 2012 (JP) ..... 2012-218494

(51) Int. Cl.
*G03G 15/06* (2006.01)

(52) U.S. Cl.
CPC ..... *G03G 15/065* (2013.01)

(58) Field of Classification Search
CPC ..... G03G 15/065
USPC ..... 399/128, 129, 55, 186
See application file for complete search history.

(56) References Cited

U.S. PATENT DOCUMENTS 5,729,808 A * 3/1998 Bisaiji ..... 399/296
5,966,560 A * 10/1999 Kodama et al. ..... 399/66
6,535,712 B2 * 3/2003 Richards ..... 399/341
7,192,474 B2 * 3/2007 Auslander et al. ..... 106/31.32
2005/0281569 A1 * 12/2005 Nishimura ..... 399/31
2006/0056857 A1 * 3/2006 Watanabe et al. ..... 399/12
2007/0274747 A1 * 11/2007 Kimura et al. ..... 399/302
2008/0113286 A1 * 5/2008 Shimoyama et al. ..... 430/69

FOREIGN PATENT DOCUMENTS

JP H08-137165 A 5/1996

* cited by examiner

*Primary Examiner* — David Gray
*Assistant Examiner* — Sevan A Aydin
(74) *Attorney, Agent, or Firm* — Banner & Witcoff, Ltd.

(57) ABSTRACT

An image forming apparatus includes a charging member for charging a surface of a photosensitive member to a first potential, an exposing member for partially exposing the charged surface of the photosensitive member such that a potential of the exposed portions becomes a second potential smaller than the first potential, a developer carrier for feeding developer onto the photosensitive member, a discharging-beam member for irradiating a discharging beam onto the photosensitive member having a developer image, and a control device configured to: control a developing bias to become a third potential larger than the second potential and smaller than the first potential; and control a discharging bias such that a potential of portions on the photosensitive member where the developer image has not been formed becomes a fourth potential not smaller than the third potential and smaller than the first potential.

3 Claims, 3 Drawing Sheets

IMAGE FORMING APPARATUS

CROSS-REFERENCE TO RELATED APPLICATIONS

This application claims priority from Japanese Patent Application No. 2012-218494 filed on Sep. 28, 2012 the entire subject matter of which is incorporated herein by reference.

TECHNICAL FIELD

Illustrative aspects of the present invention relate to an image forming apparatus using an electrophotographic method.

BACKGROUND

As an image forming apparatus using an electrophotographic method, there is known a printer which has photosensitive members for carrying developer images, and transfer members for transferring the developer images formed on the photosensitive members onto a sheet.

For example, there has been proposed a related-art color image forming apparatus which has photosensitive drums, a plurality of developing units that is arranged in parallel along peripheries of the photosensitive drums, and transfer rollers that are provided on the downstream sides of the plurality of developing units in the rotation directions of the photosensitive drums such that they face the photosensitive drums.

In this color image forming apparatus, pre-transfer lighting means (PTL) are provided between the plurality of developers and the transfer rollers. Then, before toner images formed on the photosensitive drums are transferred onto a sheet P, infrared beams are irradiated onto the photosensitive drums by the pre-transfer lighting means. In this way, the potentials of the surfaces of the photosensitive drums are generally lowered, whereby the potential difference between portions of the surfaces of the photosensitive drums having no toner attached thereto and portions of the surfaces of the photosensitive drums having toner attached thereto is reduced.

SUMMARY

In the above-described related-art color image forming apparatus, black toner obtained by mixing colorants for magenta, yellow, and cyan toner is used to transmit infrared light.

However, in a case of using black toner which absorbs infrared light, such as black toner containing carbon black, it is unable to lower the potential of portions having toner attached thereto.

Thus, in a case where infrared beams are irradiated onto the photosensitive drums, the potential of the portions having no toner attached thereto becomes lower than the potential of the portions having the toner attached thereto, whereby the toner attached to the portions having the toner attached thereto electrically moves and scatters toward the portions having no toner attached thereto.

Therefore, illustrative aspects of the present invention provide an image forming apparatus capable of suppressing scattering of developer forming developer images.

According to one illustrative aspect of the present invention, there is provided an image forming apparatus comprising: a photosensitive member; a charging member configured to charge a surface of the photosensitive member to a first potential; an exposing member configured to partially expose the charged surface of the photosensitive member such that a potential of the exposed portions becomes a second potential whose absolute value is smaller than that of the first potential; a developer carrier configured to carry developer, which absorbs light capable of lowering the surface potential of the photosensitive member, and to feed the developer onto the photosensitive member; a discharging-beam member configured to irradiate a discharging beam onto the surface of the photosensitive member having a developer image formed thereon; and a control device configured to control a bias to be applied to the developer carrier and a bias to be applied to the discharging-beam member.

The control device is configured to control the bias to be applied to the developer carrier to become a third potential whose absolute value is larger than the absolute value of the second potential and is smaller than the absolute value of the first potential. Further, the control device is configured to control the bias to be applied to the discharging-beam member such that the potential of portions of the surface of the photosensitive member where the developer image has not been formed becomes a fourth potential whose absolute value is equal to or larger than the absolute value of the third potential and is smaller than the absolute value of the first potential.

According thereto, the portions of the surface of the photosensitive member having the developer image formed thereon are charged to the first potential by the charging member, and then are exposed by the exposing member such that they have the second potential lower than the first potential. Incidentally, the potential of the portions of the surface of the photosensitive member having the developer image formed thereon is increased from the second potential such that it approaches the potential (the third potential) of the bias applied to the developer carrier during feeding of the developer from the developer carrier.

On the other hand, the portions of the surface of the photosensitive member having no developer image formed thereon are charged to the first potential by the charging member, and then are discharged by the discharging beam such that the potential thereof is reduced to the fourth potential which is equal to or higher than the potential (the third potential) of the bias applied to the developer carrier and is lower than the first potential.

Therefore, both of the portions of the surface of the photosensitive member having the developer image formed thereon and the portions of the surface of the photosensitive member having no developer image formed thereon approach the potential (the third potential) of the bias applied to the developer carrier. Consequently, it is possible to reduce the potential difference between the potential of the portions having the developer image formed thereon and the potential of the portions having no developer image formed thereon.

Besides, it is possible to make the potential of the portions having no developer image formed thereon equal to or higher than the potential of the portions having the developer image formed thereon.

As a result, it is possible to prevent the developer forming the developer image from scattering from the portions having the developer image formed thereon toward the portions having no developer image formed thereon.

DETAILED DESCRIPTION

1. Overall Configuration of Printer

Figure 1:
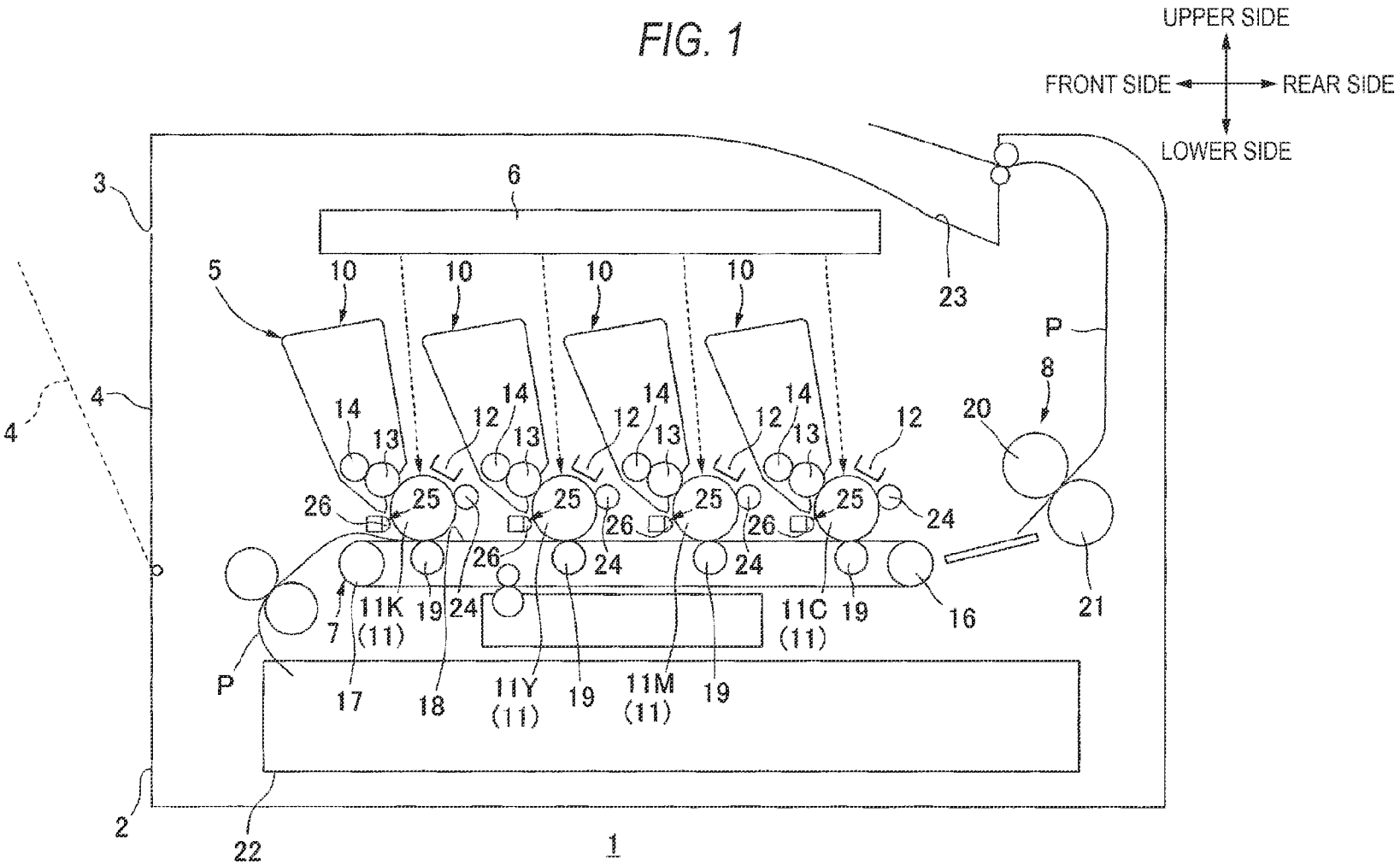
FIG. 1 is a sectional side view illustrating a printer as an exemplary embodiment of an image forming apparatus of the present invention.

As shown in FIG. 1, a printer 1, which is an example of an image forming apparatus, is a transverse direct-tandem type color printer.

In the following description, when directions of the printer 1 are stated, the upper side and lower side of the printer refer to a state where the printer 1 is horizontally installed. That is, referring to FIG. 1, the upper side and lower side of the drawing sheet are referred to as the upper side and lower side of the printer 1, respectively. Further, the left side and right side of the drawing sheet are referred to as the front side and rear side of the printer 1, respectively. Furthermore, the left side and right side of the printer 1 refer to the state of the printer as seen from the front side of the printer. That is, a direction toward a viewer of FIG. 1 is referred to as the right side of the printer, and a direction away from the viewer of FIG. 1 as the left side of the printer.

The printer 1 includes a main body casing 2 having substantially a box shape. At a front end portion of the main body casing 2, a front cover 4 for opening and closing a main body opening 3 is provided to be able to swing on a lower end portion of the front cover.

Further, the printer 1 includes a process unit 5, a scanner unit 6 which is an example of an exposing member, a transfer unit 7, and a fixing unit 8, inside the main body casing 2.

The process unit 5 is provided at the center of the main body casing 2. The process unit 5 is configured to be slideable in the front-rear direction, and be able to be drawn out of the main body casing 2 through the main body opening 3.

The process unit 5 includes: a plurality of (four) photosensitive drums 11 which is examples of a photosensitive member; a plurality of (four) scorotron chargers 12 which is examples of a charging member; a plurality of (four) drum cleaning rollers 24 which is examples of a cleaning member; and a plurality of (four) developing cartridges 10.

The plurality of photosensitive drums 11 corresponds to colors of black, yellow, cyan, and magenta, respectively, and includes a black photosensitive drum 11K, and color photosensitive drums 11 (a yellow photosensitive drum 11Y, a magenta photosensitive drum 11M and a cyan photosensitive drum 11C). The black photosensitive drum 11K is an example of a first photosensitive member for forming black images. The color photosensitive drums 11 are examples of a second photosensitive member which is used together with the black photosensitive drum 11K to form color images. The plurality of photosensitive drums 11 is arranged in parallel at intervals from the front side toward the rear side, in an order of the black photosensitive drum 11 which is an example of the first photosensitive member, the yellow photosensitive drum 11Y which is an example of the second photosensitive member, the magenta photosensitive drum 11M which is an example of the second photosensitive member, and the cyan photosensitive drum 11C which is an example of the second photosensitive member. The photosensitive drums 11 are formed in a cylindrical shape long in the left-right direction.

The plurality of scorotron chargers 12 is provided to face the upper rear sides of the plurality of photosensitive drums 11 with gaps, respectively.

The plurality of drum cleaning rollers 24 comes into contact with the plurality of photosensitive drums 11 from the rear side, respectively.

The plurality of developing cartridges 10 is provided on the plurality of photosensitive drums 11, respectively. Each developing cartridge 10 includes a developing roller 13 which is an example of a developer carrier.

Each developing roller 13 is supported at a lower end portion of a corresponding developing cartridge 10 so as to be rotatable and exposed to the lower rear side. Further, each developing roller 13 comes into contact with a corresponding photosensitive drum 11 from the upper front side.

Incidentally, each developing cartridge 10 includes a feeding roller 14 for feeding toner to a corresponding developing roller 13 and a layer-thickness regulating blade (not shown) for regulating the thickness of the toner fed on the corresponding developing roller 13. Each developing cartridge 10 is configured to contain toner, which is an example of developer and has a corresponding color, inside a space above the feeding roller 14 and the layer-thickness regulating blade.

The scanner unit 6 is supported inside an upper end portion of the main body casing 2 such that it faces the top of the process unit 5. On the basis of image data, the scanner unit 6 emits laser beams (having a wavelength of 780 nm) toward the plurality of photosensitive drums 11, respectively, as shown by broken lines.

The transfer unit 7 is provided to face the lower side of the process unit 5. The transfer unit 7 includes: a driving roller 16; a driven roller 17; a conveyor belt 18; and a plurality of (four) transfer rollers 19 which is examples of a transfer member.

The driving roller 16 is rotatably supported at a rear end portion of the transfer unit 7.

The driven roller 17 is rotatably supported at a front end portion of the transfer unit 7.

The conveyor belt 18 is provided around the driving roller 16 and the driven roller 17 such that the upper portion of the conveyor belt 18 comes into contact with all photosensitive drums 11. Driving of the driving roller 16 and following of the driving roller 16 cause the conveyor belt 18 to circulate such that the upper portion of the conveyor belt 18 moves from the front side toward the rear side.

The plurality of transfer rollers 19 is provided below the plurality of photosensitive drums 11 such that they face the photosensitive drums 11, respectively, with the upper portion of the conveyor belt 18 interposed therebetween.

The fixing unit 8 is provided to face the rear side of the transfer unit 7. The fixing unit 8 includes a heating roller 20 and a pressing roller 21 that faces the heating roller 20.

Then, the toner contained in the developing cartridges 10 is triboelectrically and positively charged between the feeding rollers 14 and the developing rollers 13, and is carried on the development rollers 13 as thin layers having a uniform thickness by the layer-thickness regulating blades (not shown).

On the other hand, the surfaces of the photosensitive drums 11 are uniformly and positively charged by the scorotron chargers 12, and are then exposed on the basis of predetermined image data by the scanner unit 6. As a result, on the surfaces of the photosensitive drums 11, electrostatic latent images based on the image data are formed. Then, the toner carried on the developing rollers 13 is fed to the electrostatic latent images formed on the surfaces of the photosensitive drums 11, whereby toner images (developer images) are carried on the surfaces of the photosensitive drums 11.

Sheet P which is an example of a recording medium is stored in a sheet feeding tray 22 that is provided at the bottom of the main body casing 2. The sheet P is conveyed to make a U-turn toward the upper rear side by various rollers, and is fed one at a time into the gap between the photosensitive drums 11 and the conveyor belt 18 at predetermined timings. Then, the sheet is conveyed from the front side toward the rear side through the gaps between all the photosensitive drums 11 and all the transfer rollers 19 by the conveyor belt 18. That is, the direction from the front side toward the rear side is a conveyance direction. At this time, the toner images are transferred onto a sheet P.

Then, when the sheet P passes through the gap between the heating roller 20 and the pressing roller 21, the sheet P is heated while being pressed. At this time, the toner image is thermally fixed on the sheet P.

Thereafter, the sheet P is conveyed to make a U-turn toward the upper front side, and is discharged to a sheet discharge tray 23 provided at the top of the main body casing 2.

2. Photosensitive Drum

Each photosensitive drum 11 includes: a metal pipe having a substantially cylindrical shape; and a positively chargeable photosensitive layer that is formed on the metal pipe and whose outermost surface layer is formed of polycarbonate.

Upon the positively charged photosensitive layers of the photosensitive drums 11 being exposed, by beams having a wavelength of 780 nm, for example, the surface potentials thereof lower.

3. Discharging Unit

The process unit 5 further includes a plurality of (four) discharging units 25 which is examples of a discharging-beam member.

The plurality of discharging units 25 is provided to face the front sides of the plurality of photosensitive drums 11 with gaps, respectively. Incidentally, a discharging unit 25 facing the black photosensitive drum 11K is an example of a first discharging-beam member. Further, discharging units 25 facing the yellow photosensitive drum 11Y, the magenta photosensitive drum 11M, and the cyan photosensitive drum 11C are examples of a second discharging-beam member. The photosensitive drums 11 are formed in a cylindrical shape long in the left-right direction. Each discharging unit 25 has an LED 26 at a rear end portion thereof, and irradiates a discharging beam onto a corresponding photosensitive drum 11.

The wavelengths of the discharging beams which are irradiated by the discharging units 25 are, for example, 780 nm to 1,000 nm, preferably, 800 nm to 950 nm. If the wavelengths of the discharging beams are less than the above-described range, the discharging beams may be absorbed by the toner images carried on the surfaces of the photosensitive drums 11, such that it becomes difficult for the potentials of portions having the toner images carried thereon to lower. Further, if the wavelengths of the discharging beams are greater than the above-described range, it may become difficult for the potentials of the surfaces of the photosensitive drums 11 to lower.

4. Toner

The toner of each color contains at least a binder resin, a charge control resin, and a colorant.

The binder resin is a main component of the toner, and may be, for example, a polyester resin.

The charge control resin is contained for making the toner positively chargeable, and may be, for example, a synthetic resin having cationic groups.

Each colorant is for giving a desired color to toner, and is dispersed or permeated in the binder resin.

As a black colorant, carbon black can be exemplified.

As a magenta colorant, an azo-based pigment can be exemplified.

As a yellow colorant, a naphthol-based pigment can be exemplified.

As a cyan colorant, a phthalocyanine-based pigment can be exemplified.

The black toner absorbs, for example, 90% or more of a discharging beam irradiated by a corresponding discharging unit 25. That is, the black toner absorbs the discharging beam irradiated by the corresponding discharging unit 25.

The magenta toner absorbs, for example, 10% or less, preferably, 5% or less of a discharging beam irradiated by a corresponding discharging unit 25. That is, the magenta toner does not absorb but transmits most of the discharging beam irradiated by a corresponding discharging unit 25.

The yellow toner absorbs, for example, 10% or less, preferably, 5% or less of a discharging beam irradiated by a corresponding discharging unit 25. That is, the yellow toner does not absorb but transmits most of the discharging beam irradiated by a corresponding discharging unit 25.

The cyan toner absorbs, for example, 15% or less, preferably, 10% or less of a discharging beam irradiated by a corresponding discharging unit 25. That is, the cyan toner does not absorb but transmits most of the discharging beam irradiated by a corresponding discharging unit 25.

Figure 2:
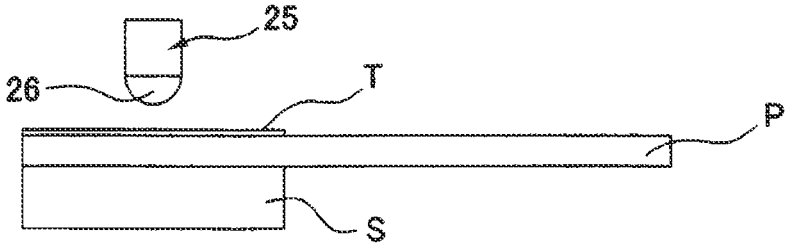
FIG. 2 is an explanatory view illustrating a measurement direction of the light absorption rate of toner.

Incidentally, the light absorption rate of the toner is measured, for example, with an optical power meter (TQ8210 made by ADVANTEST Corp.), as shown in FIG. 2.

Specifically, in order to measure the light absorption rate of the toner, first, a beta image T is printed on a surface of a sheet P.

Next, in a darkroom, a discharging unit 25 is provided on the side of the sheet P having the beta image T printed thereon, and an optical power meter S is provided on the side of the sheet P having no beta image T printed thereon.

Then, the beta image T is exposed by the discharging unit 25, and light having passed through the sheet P is measured with the optical power meter S. Incidentally, in the optical power meter S, the light having passed through the sheet P is converted into electric power (W) which is measured.

Separately, an area of the sheet P having no beta image T formed thereon is exposed by the discharging unit 25, and light having passed through the sheet P is measured with the optical power meter S.

If the measured value of the light having passed through the area having no beta image T formed thereon is L0, and the measured value of the light having passed through the beta image T is L1, the difference (L0−L1) between the two measured values corresponds to light absorbed by the toner.

Then, a percentage ((L0−L1)/L0×100) of the light having passed through the area having no beta image T, relative to the light (L0−L1) absorbed by the toner, is the light absorption rate of the toner.

5. Electrical Configuration of Printer

Figure 3:
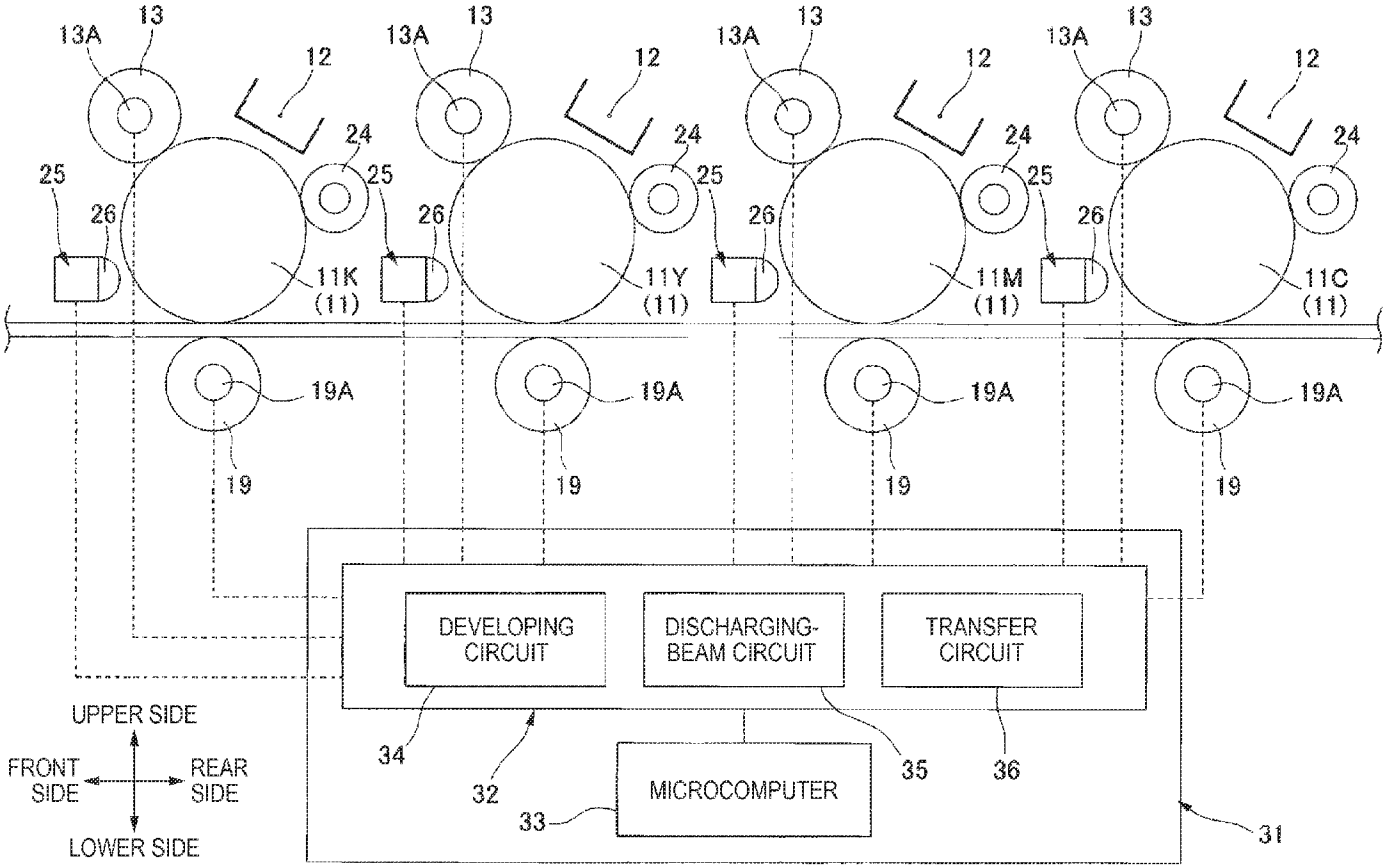
FIG. 3 is a block diagram illustrating a main portion of the electrical configuration of the printer shown in FIG. 1.

As shown in FIG. 3, inside the main body casing 2, a control unit 31 (one example of a control device) for controlling the operation of the printer 1 is provided.

The control unit 31 includes a circuit board 32, and a microcomputer 33.

The circuit board 32 includes a developing circuit 34 for supplying electric power to the developing rollers 13, a discharging-beam circuit 35 for supplying electric power to the discharging units 25, and a transfer circuit 36 for supplying electric power to the transfer rollers 19.

The developing circuit 34 is electrically connected to the metal rotating shafts of the developing rollers 13 (developing roller shafts 13A) through wiring lines. On the basis of control of the microcomputer 33, the developing circuit 34 adjusts a voltage from a power source (not shown) of the inside of the main body casing 2, to a predetermined voltage (bias), and applies the predetermined voltage to the developing roller shafts 13A.

The discharging-beam circuit 35 is electrically connected to the discharging units 25 through wiring lines. On the basis of control of the microcomputer 33, the discharging-beam circuit 35 adjusts the voltage from the power source (not shown) of the inside of the main body casing 2, to a predetermined voltage (bias), and applies the predetermined voltage to the LEDs 26 of the discharging units 25.

The transfer circuit 36 is electrically connected to the metal rotating shafts of the transfer rollers 19 (transfer roller shafts 19A) through wiring lines. On the basis of control of the microcomputer 33, the transfer circuit 36 adjusts the voltage from the power source (not shown) of the inside of the main body casing 2, to predetermined voltages (biases), and applies the predetermined voltages to the transfer roller shafts 19A. More specifically, the transfer circuit 36 separately applies different biases to the plurality of transfer rollers 19, respectively, such that a predetermined transfer current flows between each transfer roller 19 and a corresponding photosensitive drum 11. In this way, the transfer circuit 36 applies an electric current between each of the plurality of transfer rollers 19 and a corresponding photosensitive drum 11, thereby capable of appropriately transferring toner images formed on the photosensitive drums 11 onto a sheet P.

The microcomputer 33 is electrically connected to the developing circuit 34 and the discharging-beam circuit 35 through signal lines. The microcomputer 33 includes a CPU, a memory, and so on. The microcomputer 33 controls the developing circuit 34 and the discharging-beam circuit 35 according to program processing of the CPU.

6. Image Forming Operation

Upon the above-described image forming operation being performed, the surfaces of the photosensitive drums 11 are uniformly charged to a predetermined charge potential (the first potential) by the scorotron chargers 12. The first potential is, for example, +800 V.

Thereafter, on the basis of predetermined image data, the surfaces of the photosensitive drums 11 are exposed by the scanner unit 6. The potential of exposed portions is reduced to a predetermined potential (the second potential). The second potential is, for example, +150 V. That is, the absolute value of the second potential is smaller than that of the first potential.

In that way, on the surfaces of the photosensitive drums 11, electrostatic latent images based on the image data are formed.

The microcomputer 33 controls the developing circuit 34, such that the developing circuit 34 applies a developing bias to the developing rollers 13. The potential of the developing bias (the third potential) is, for example, +400 V. That is, the absolute value of the third potential is larger than the absolute value of the second potential and is smaller than the absolute value of the first potential.

Subsequently, as described above, the toner contained in the developing cartridges 10 is triboelectrically and positively charged between the feeding rollers 14 and the developing rollers 13, and is carried, as thin layers having a uniform thickness, on the development rollers 13.

Then, the toner carried on the developing rollers 13 is fed to the electrostatic latent images formed on the surfaces of the photosensitive drums 11, whereby toner images (developer images) are carried on the surfaces of the photosensitive drums 11.

At this time, the potentials of the portions of the surfaces of the photosensitive drums 11 having the toner images formed thereon become, for example, +300 V to +350 V. Incidentally, the potentials of the portions of the surfaces of the photosensitive drums 11 having no toner images formed thereon are maintained at the first potential (for example, +800 V).

Subsequently, the photosensitive drums 11 carrying the toner images are exposed by discharging beams from the discharging units 25.

At this time, the microcomputer 33 controls the discharging-beam circuit 35, thereby adjusting the amounts of discharging beams to be irradiated by the discharging units 25.

As a result, the potential of the portions of the surface of the black photosensitive drum 11K having no toner image formed thereon (the fourth potential) becomes, for example, +350 V to +650 V, preferably, +350 V to +450 V. That is, the absolute value of the fourth potential is equal to or larger than the absolute value of the third potential, and is smaller than the absolute value of the first potential.

Incidentally, the potential of the portions of the surface of the black photosensitive drum 11K having the toner image formed thereon is, for example, from +300 V to +350 V as described above.

Further, the potential of the portions of the surfaces of the yellow photosensitive drum 11Y, the magenta photosensitive drum 11M, and the cyan photosensitive drum 11C having no toner images formed thereon (the fifth potential) is, for example, +50 V to 300 V, preferably, +50 V to +100 V, and the potential of the portions of the surfaces of the yellow photosensitive drum 11Y, the magenta photosensitive drum 11M, and the cyan photosensitive drum 11C having the toner images formed thereon (the sixth potential) is, for example, +50 V to 300 V, preferably, +50 V to +100 V. That is, the absolute value of the fifth potential is smaller than the absolute value of the third potential, and is smaller than the absolute value of the second potential. Further, the absolute value of the sixth potential is equal to or smaller than the absolute value of the fifth potential.

Subsequently, as described above, the toner images carried on the surfaces of the photosensitive drums 11 are transferred onto a sheet P by transfer currents flowing between the photosensitive drums 11 and the transfer rollers 19.

At this time, on the peripheral surfaces of the photosensitive drums 11, toner which is an example of deposits having not been transferred onto the sheet P (hereinafter, referred to as post-transfer residual toner) may remain.

Thereafter, rotating of the photosensitive drums 11 causes the post-transfer residual toner remaining on the peripheral surfaces of the photosensitive drums 11 to face corresponding drum cleaning rollers 24.

Then, the post-transfer residual toner is electrostatically held on the peripheral surfaces of corresponding drum cleaning rollers 24 by a drum cleaning bias.

7. Advantages (1) According to the printer 1, the portions of the surface of the black photosensitive drum 11K having the toner image formed thereon are charged to the first potential (e.g., +800 V) by a corresponding scorotron charger 12, and then are exposed by the scanner unit 6 such that the potential thereof becomes the second potential (e.g., +150 V) lower than the first potential (e.g., +800 V). Further, the potential of the portions of the surface of the black photosensitive drum 11K having the toner image formed thereon is increased from the second potential (e.g., +150 V) to approach the potential (e.g., +400 V) of the bias applied to the developing cartridges 10 during feeding of the toner from the developing rollers 13.

On the other hand, the portions of the black photosensitive drum 11K having no toner image formed thereon are charged to the first potential (e.g., +800 V) by the corresponding scorotron charger 12, and then are exposed by a discharging beam such that the potential thereof lowers to the fourth potential (e.g., +300 V to +650 V).

Therefore, all of the portions of the surface of the black photosensitive drum 11K having the toner image formed thereon and the portions of the surface of the black photosensitive drum 11K having no toner image formed thereon approach the potential (e.g., +400 V) of the bias applied to the developing rollers 13. Consequently, it is possible to reduce the potential difference between the potential of the portions having the toner image formed thereon and the potential of the portions having no toner image formed thereon.

Further, it is possible to make the potential of the portions having no toner image formed thereon equal to or higher than the potential of the portions having the toner image formed thereon.

As a result, it is possible to prevent the toner forming the toner image from scattering from the portions having the toner image formed thereon toward the portions having no toner image formed thereon.

If the photosensitive drums 11 are not exposed by the discharging units 25 like the related art, the potential difference between the potential of portions of the surfaces of the photosensitive drums 11 having the toner images formed thereon and the potential of portions of the surfaces of the photosensitive drums 11 having no toner images formed thereon is large.

For this reason, transfer currents which flow between the photosensitive drums 11 and the transfer rollers 19 at nip portions between the photosensitive drums 11 and the transfer rollers 19 tend to be likely to flow to the portions having no toner images formed thereon, and thus in order to secure transfer currents in the portions having the toner images formed thereon, it is necessary to apply comparatively large transfer currents between the photosensitive drums 11 and the transfer rollers 19.

In this respect, according to the above-described printer 1, it is possible to reduce the potential difference between the potential of the portions of the surfaces of the photosensitive drums 11 having the toner images formed thereon and the potential of the portions of the surfaces of the photosensitive drums 11 having no toner images formed thereon.

Therefore, it is possible to suppress transfer currents which flow between the photosensitive drums 11 and the transfer rollers 19 at the nip portions between the photosensitive drums 11 and the transfer rollers 19 from flowing to the portions having no toner images formed thereon.

As a result, it is possible to secure transfer currents at the portions having the toner images formed thereon, even though the transfer currents are comparatively small, and to reduce transfer currents which flow between the photosensitive drums 11 and the transfer rollers 19.

(2) Further, according to the printer 1, it is possible to generally reduce the potential of the surface of the yellow photosensitive drum 11Y, the magenta photosensitive drum 11M, or the cyan photosensitive drum 11C by a discharging beam such that the potential of the portions having no toner image formed thereon becomes the fifth potential (e.g., +50 V to +300 V), and the potential of the portions having the toner image formed thereon becomes the sixth potential (e.g., +50 V to +300 V).

Therefore, it is possible to uniformize not only the potential of the surface of the black photosensitive drum 11K but also the potentials of the surfaces of the yellow photosensitive drum 11Y, the magenta photosensitive drum 11M, and the cyan photosensitive drum 11C.

Besides, even with respect to the yellow photosensitive drum 11Y, the magenta photosensitive drum 11M, and the cyan photosensitive drum 11C, it is possible to make the potential of the portions having no toner images formed thereon equal to or higher than the potential of the portions having the toner images formed thereon.

As a result, in a configuration including a plurality of photosensitive drums 11, and using not only toner which absorbs beams capable of lowering the potentials of the surfaces of the photosensitive members (black toner containing carbon black) but also toner which transmits beams capable of lowering the potentials of the surfaces of the photosensitive drums 11 (yellow toner, magenta toner, and cyan toner), with respect to all photosensitive drums 11, it is possible to prevent toner forming toner images from scattering from portions having the toner images formed thereon toward portions having no toner images formed thereon.

Further, since the fifth potential is lower than the first potential, and the fifth potential is substantially equal to the sixth potential, it is possible to further reduce transfer currents which flow between the photosensitive drums 11 and the transfer rollers 19 corresponding to colors (yellow, magenta, and cyan).

(3) Further, according to the printer 1, the potential (e.g., +50 V to +100 V) of the portions of the surface of the yellow photosensitive drum 11Y, the magenta photosensitive drum 11M, or the cyan photosensitive drum 11C having no toner image formed thereon is lower than the second potential (e.g., +150 V).

According to this configuration, it is possible to generally make the potentials of the surfaces of the yellow photosensitive drum 11Y, the magenta photosensitive drum 11M, and the cyan photosensitive drum 11C lower than the second potential (e.g., +150 V).

Therefore, it is possible to further uniformize the potentials of the surfaces of the yellow photosensitive drum 11Y, the magenta photosensitive drum 11M, and the cyan photosensitive drum 11C, and to further prevent scattering of the toner.

(4) Further, according to the printer 1, it is possible to irradiate discharging beams onto the surfaces of corresponding photosensitive drums 11 through the yellow toner, the magenta toner, and the cyan toner absorbing visible light.

Therefore, it is possible to easier reduce the potentials of the surfaces of the photosensitive drums 11.

(5) Further, according to the printer 1, it is possible to clean the surfaces of the photosensitive drums 11 by the drum cleaning rollers 24.

Therefore, it is possible to prevent toner remaining on the surfaces of the photosensitive drums 11 from being attached to a sheet P during the next printing.

8. Modification

In the above-described exemplary embodiment, in the color printer, a discharging beam is irradiated onto a photosensitive drum 11 corresponding to black, whereby portions having no toner image formed thereon are discharged such that the potential thereof becomes a potential which is equal to or higher than the developing bias and is lower than the charge potential of the corresponding photosensitive drum 11.

This discharging-beam irradiation of a discharging unit 25 may be applied even to a monochrome printer configured to print only black images.

What is claimed is:

1. An image forming apparatus comprising:

a plurality of photosensitive members comprising:

a first photosensitive member that corresponds to developer which absorbs light capable of lowering the surface potentials of the photosensitive members; and a second photosensitive member that corresponds to developer which transmits light capable of lowering the surface potentials of the photosensitive members;

a charging member configured to charge a surface of each of the photosensitive members to a first potential;

an exposing member configured to partially expose the charged surfaces of the photosensitive members such that a potential of exposed portions becomes a second potential whose absolute value is smaller than that of the first potential;

a developer carrier configured to carry developer, which absorbs light capable of lowering the surface potentials of the photosensitive members, and to feed the respective developer onto the photosensitive members;

a plurality of discharging-beam members corresponding to the plurality of photosensitive members, respectively, and configured to irradiate a discharging beam onto corresponding surfaces of the photosensitive members having a developer image formed thereon, the plurality of discharging-beam comprising:

a first discharging-beam member that corresponds to the first photosensitive member; and a second discharging-beam member that corresponds to the second photosensitive member; and a control device configured to control a bias to be applied to the developer carrier and a bias to be applied to the discharging-beam members, wherein the control device is configured to control the bias to be applied to the developer carrier to become a third potential whose absolute value is larger than the absolute value of the second potential and is smaller than the absolute value of the first potential, and wherein the control device is configured to control a bias to be applied to the first discharging-beam member such that the potential of portions of the surface of the first photosensitive member where the developer image has not been formed becomes a fourth potential whose absolute value is equal to or larger than the absolute value of the third potential and is smaller than the absolute value of the first potential, and wherein the control device is configured to control a bias to be applied to the second discharging-beam member such that:

the potential of portions of the surface of the second photosensitive member where the developer image has not been formed becomes a fifth potential whose absolute value is smaller than the absolute value of the third potential and is smaller than the absolute value of the second potential; and the potential of portions of the surface of the second photosensitive member where the developer image has been formed becomes a sixth potential whose absolute value is equal to or smaller than the absolute value of the fifth potential.

2. The image forming apparatus according to claim 1, wherein at least one of the discharging-beam members is configured to irradiate the discharging beam having a wavelength of 780 nm to 1,000 nm onto the surface of at least one of the photosensitive members.

3. The image forming apparatus according to claim 1, further comprising:

a plurality of cleaning members each configured to clean the surfaces of one of the photosensitive members after the developer image is transferred onto a recording medium.

* * * * *